US006324815B2

(12) United States Patent
Brollier et al.

(10) Patent No.: US 6,324,815 B2
(45) Date of Patent: Dec. 4, 2001

(54) APPARATUS AND METHOD FOR STERILIZING AN ASEPTIC WEB

(75) Inventors: Brian W. Brollier, Cincinnati; Michael F. Showler, Loveland, both of OH (US)

(73) Assignee: International Paper Company

( * ) Notice: Subject to any disclaimer, the term of this patent is extended or adjusted under 35 U.S.C. 154(b) by 0 days.

(21) Appl. No.: 09/378,588

(22) Filed: Aug. 20, 1999

(51) Int. Cl.[7] ..... B65B 55/04

(52) U.S. Cl. ..... 53/426; 53/428; 53/431; 53/111 R

(58) Field of Search ..... 53/167, 428, 431, 53/425, 426, 111 R, 565

(56) References Cited

U.S. PATENT DOCUMENTS 3,904,361 * 9/1975 Egger .
4,225,556 * 9/1980 Lothman et al. .
4,233,271 * 11/1980 Ernstsson et al. .
4,537,007 * 8/1985 Lattanzi .
4,753,059 * 6/1988 Natterer .

* cited by examiner

*Primary Examiner*—Eugene Kim
(74) *Attorney, Agent, or Firm*—Pitts & Brittian, PC

(57) ABSTRACT

The present invention teaches apparatus and method for an improving the sterilizing of paperboard web material within the typical form, fill, and seal machines currently being used in the aseptic packaging of liquid drinks. By the present invention an anilox roll, typically used in the printing industry, has a sterilant, such as hydrogen peroxide, imbedded within the microscopic pores formed on the cylindrical surface of the roll after which the paperboard material subjected to rolling contact with the roll whereby the sterilant is uniformly applied to the paperboard thereby sterilizing the surface of the paperboard.

12 Claims, 3 Drawing Sheets

APPARATUS AND METHOD FOR STERILIZING AN ASEPTIC WEB

RELATED APPLICATIONS

This application claims the priority of U.S. Provisional Patent Application Ser. No. 60/0974,462, filed on Aug. 21, 1998.

INTRODUCTION

The present invention relates to a new improved method and apparatus for sterilizing paperboard material used for aseptic liquid containers commonly used for beverages. The method and apparatus, as taught herein, is especially useful for, but not necessarily limited too, gable top containers having a fitment attached thereto for pouring the liquid contents from the container.

BACKGROUND OF THE INVENTION

The paperboard container having a fitment, or pour spout, from which the liquid inside may be easily poured therefrom is fast becoming a standard in the milk and juice carton industry. In order to place a fitment on the typical paperboard container a hole must first be punched or cut out of the carton's surface. The presence of this hole increases the complexity of the sterilization process.

FIG. 1 presents a schematic crossection of typical prior art apparatus for sterilizing paperboard material used for liquid containers. An application roller rotatingly dips into a reservoir of sterilant, typically hydrogen peroxide. The paper board stock to be sterilized is passed through a nip between the application roller and the back up roller thereby flooding the hydrogen peroxide upon the surface of the paperboard. The flooded paperboard is then passed through a nip between the back up roller and doctor roller whereby excess hydrogen peroxide is removed from the paperboard and drips back into the reservoir.

Although this process has worked well for paperboard having a continuous surface without holes therein, for the receipt of a fitment, the doctor roller/backup roller combination is unable to remove the excess sterilant that collects within the gap, or opening, presented between the doctor roll and the backup roller by the presence of the fitment hole. Thus as the sterilized paperboard is discharged from the doctor roller/backup roller nip the accumulated sterilant, within the fitment hole flows across the paperboard leaving an undesired residual of sterilant upon the board. Similarly, for paper board having surface irregularities such as score lines etc. the prior art method of sterilization causes a build up of sterilant in the areas of surface area height differentials thereby leaving globules or droplets of sterilant upon the paperboard surface. Subsequently the, system used to dry the sterilant from the board is unable to dry the residual sterilant and many times producing a sterilized paperboard having a hydrogen peroxide residual greater than 0.5 parts per million, the industry standard.

SUMMARY OF THE INVENTION

The disadvantages of the prior art are overcome by the present invention. By the apparatus and method of the present invention an anilox roller is submerged in a bath of sterilant. As the surface of the anilox roller rotates upward out of the sterilant, excess sterilant is removed from the surface by a typical doctor blade. The paperboard web is then passed through a nip between the anilox roller and a backup or pressure roller. The sterilant retained within the pores of the anilox roller are thusly transferred from the anilox roller, in a printing like manner, as the paperboard web passes through the nip, and is deposited upon the paperboard thereby sterilizing the paperboard.

PREFERRED EMBODIMENT OF THE INVENTION

Figure 1:
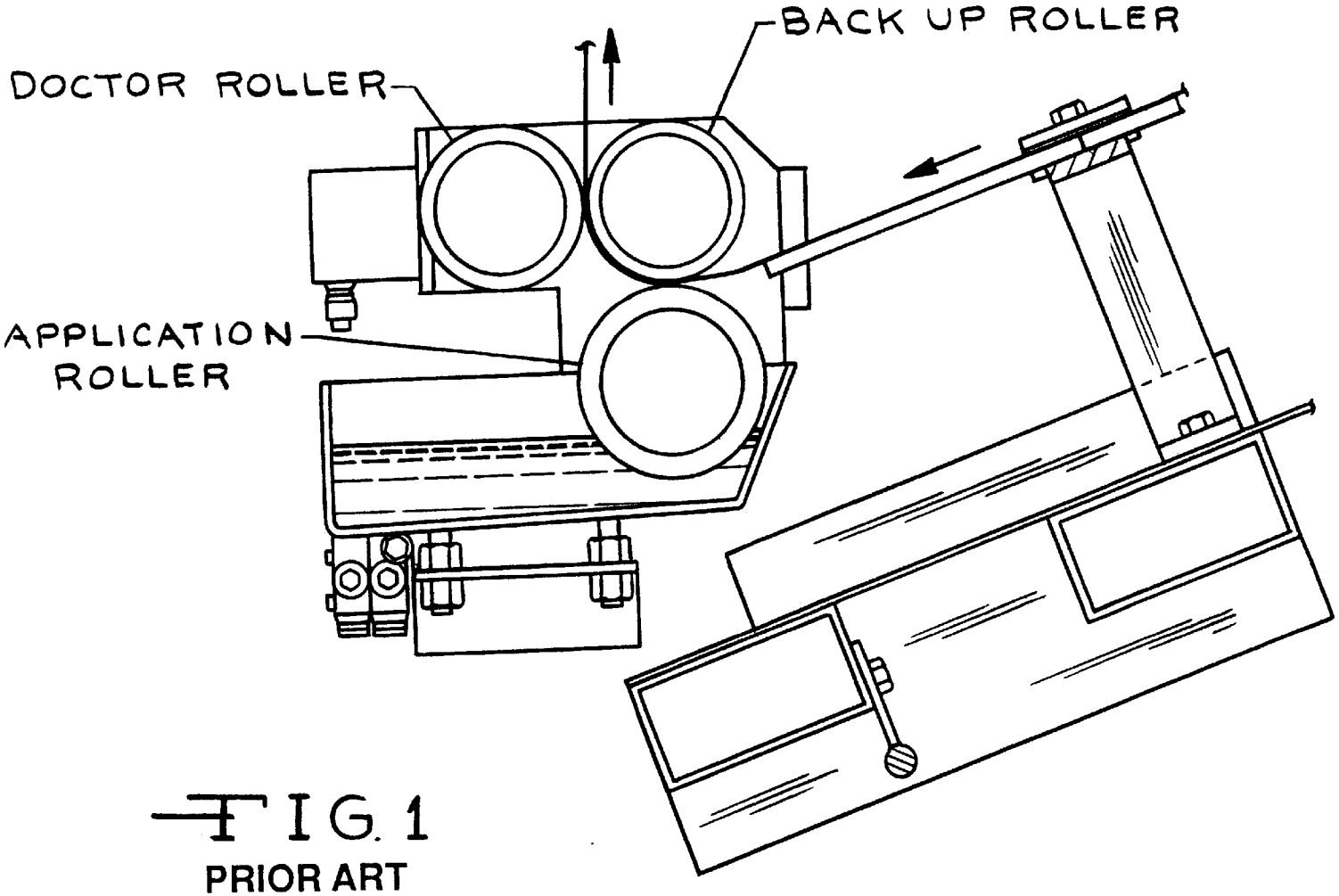
FIG. 1 PRIOR ART
FIG. 1 shows a schematic crossection of a typical prior art machine.
Figure 2:
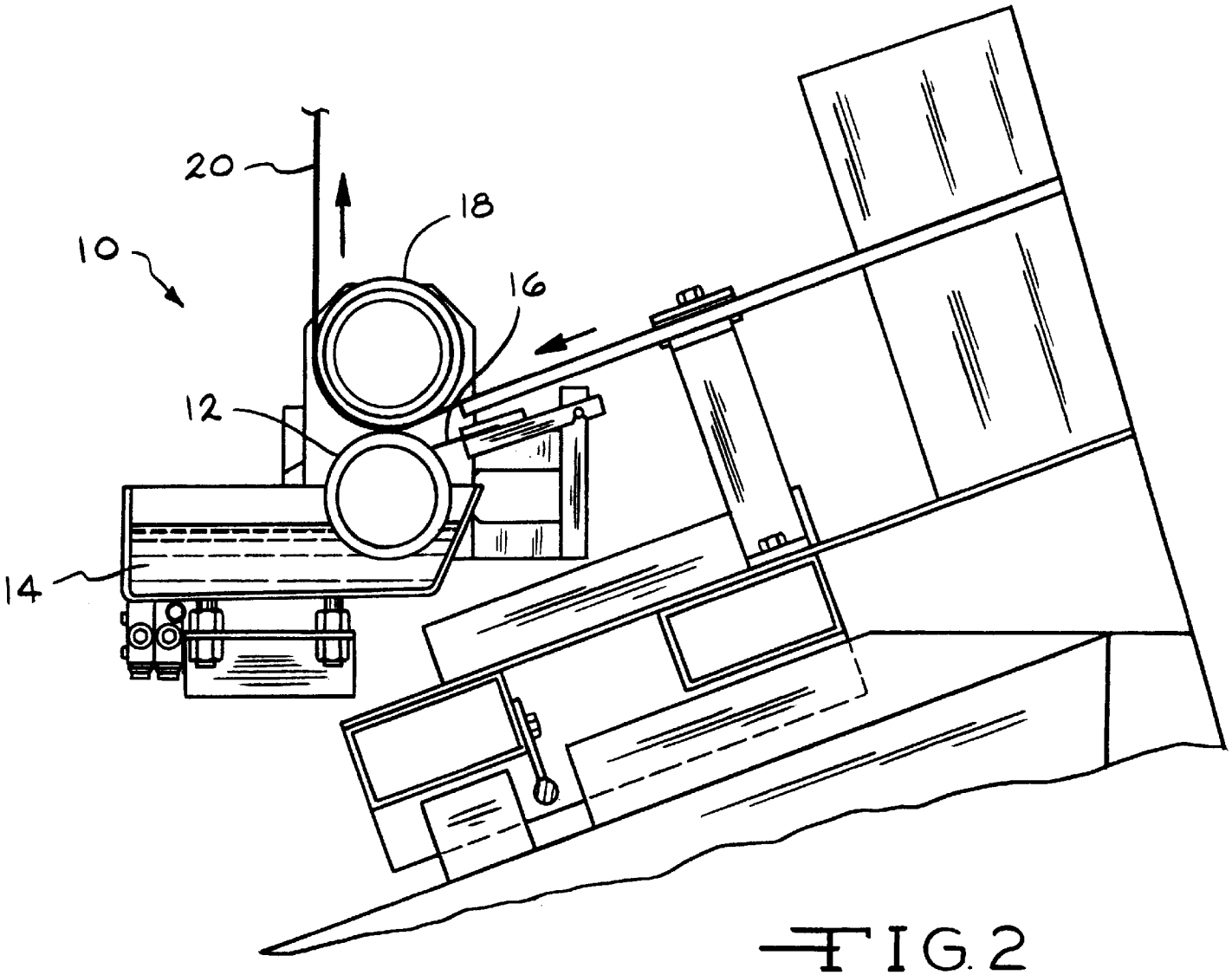
FIG. 2 shows a schematic crossection of the apparatus for practicing the present invention.
Figure 3:
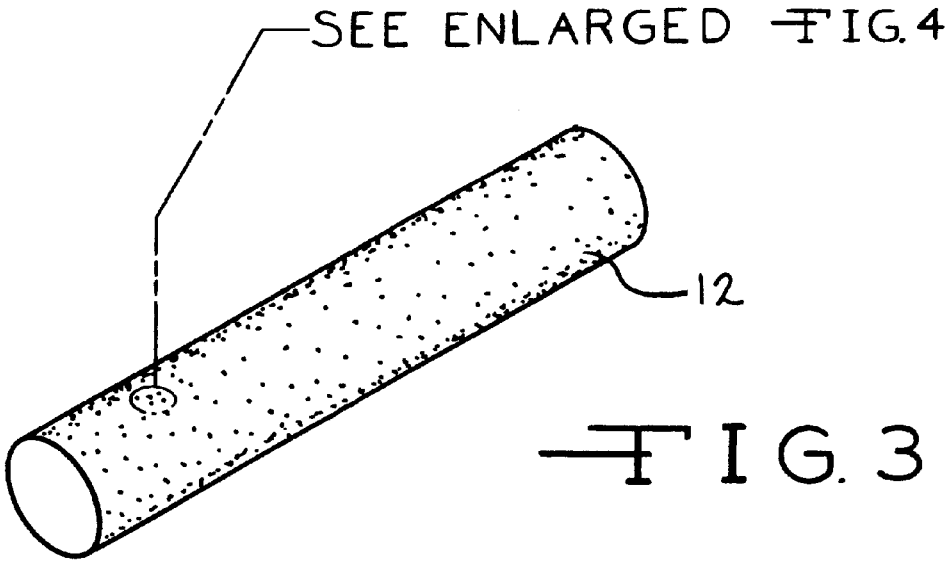
FIG. 3 presents a pictorial view of a typical anilox roll suitable for practicing the present invention.
Figure 4:
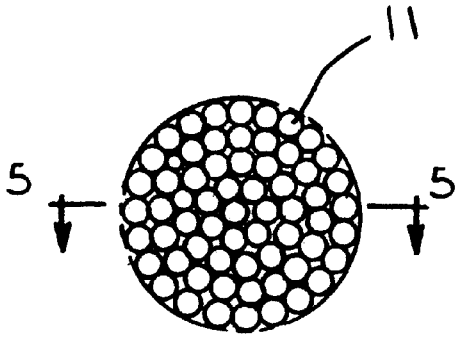
FIG. 4 is a partial enlarged view of the surface of the anilox roll as shown in FIG. 3.
Figure 5:
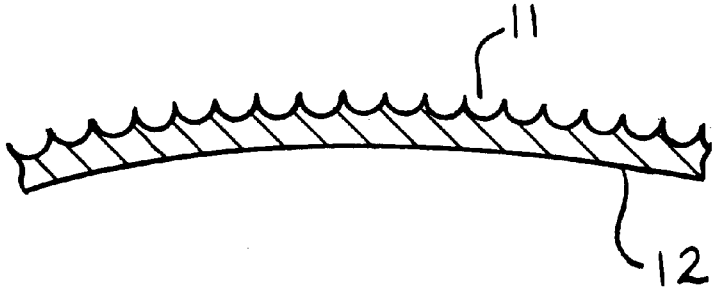
FIG. 5 is a crossectional view taken along line 5—5 of FIG. 4.

Referring now to FIG. 2, a crossectional schematic is shown of the apparatus 10 suitable for the practice of the present invention. An anilox printing roller 12 is rotatingly submerged and passed through a bath of sterilant 14 where the micro pores on the cylindrical surface of the anilox roll fill with sterilant. A trailing edge doctor blade 16 wipes excess sterilant from the surface of roll 12. Paper board 20 is continuously passed through the nip between anilox roll 12 and pressure roll 18 whereby the sterilant contained within the pores 11 of roll 12 is deposited upon paperboard 20 thereby sterilizing the paperboard surface. The wetted paperboard is then passed through a drying apparatus (not shown) and on to the filling machine.

Anilox roll 12 is similar to the anilox roll as used in the rotogravure printing process. We have found that a anilox roll comprising a laser engraved, plasma coated, ceramic covered metal roll having a uniform distribution of micro cells or pores about its cylindrical surface has performed well. The surface of roll 12 has 100 percent of its cylindrical surface engraved with a uniform array of pores having a 300 line count and 6 billion cubic microns per square inch (BCM).

An alternate method may, in addition, include a rubber transfer roll (not shown) whereby the transfer roll would rollingly engage the anilox roller whereby the sterilant would be deposited upon the transfer roll. The transfer roll would then deposit the sterilant upon the paperboard web.

Also an alternate embodiment may be structured whereby the sterilant is sprayed upon anilox roller as opposed to submerging the roll in the sterilant.

By use of the method and apparatus disclosed above the sterilant is uniformly deposited upon the paperboard surface only. Thus none of the sterilant is floodingly deposited in hole cut outs intended for fitment application thereby eliminating the undesirable collection of residual sterilant upon the paperboard.

Having described the preferred embodiments of the present invention, and several of its benefits and advantages, it will be understood by those of ordinary skill in the art that the foregoing description is merely for the purpose of illustration and that numerous substitutions, rearrangements, and modifications may be made in the invention without departing from the scope and spirit of the appended claims.

We claim:

1. A method of sterilizing a paperboard material having a surface characterized by one or more aberrations in the smoothness and/or continuity thereof comprising the steps of:

a) providing a reservoir of sterilant fluid, b) providing a roll having at least a portion of its outer circumference at least partly submerged in said fluid, said roll having defined in the outer circumference thereof a plurality of minute discrete pores opening outward of the outer circumference of the roll, said pores being spaced apart by respective minimal distances, c) rotating said roll within said fluid such that said pores of said roll receive therein a quantity of said fluid, d) removing from the outer circumference of said roll substantially all sterilant fluid not disposed within said pores, e) thereafter, passing said paperboard material over the exposed portion of said roll with the aberrated surface of the paperboard material in rolling engagement with the outer circumference of said roll and contiguous with said pores whereby the fluid contained within said pores which are engaged by said aberrated surface is wettingly transferred to said aberrated surface of said paperboard material.

2. The method of claim 1 including the step of doctoring from the outer circumferential surface of said roll substantially all sterilant fluid not disposed within said pores.

3. The method of claim 1 and including the step of providing a pressure roll having its axis substantially parallel to this axis of said roll and in rolling contact with a portion of the outer circumferential surface of said roll containing said pores after said portion of said roll containing said pores has moved through and out of said reservoir of sterilant fluid thereby removing substantially all sterilant fluid from the outer circumference of said roll containing said pores that is not disposed within said pores.

4. Apparatus for applying a sterilant fluid to at least one surface of paperboard material, the surface being characterized by one or more aberrations in the smoothness and/or continuity of the surface comprising:

a) a reservoir for containing a supply of sterilant fluid therein, b) a roll having at least a portion of its outer circumferential surface partially submerged in said sterilant fluid, said roll having defined in the outer circumference thereof a plurality of minute discrete pores opening outward of the outer circumference of said roll and being spaced apart by respective minimal distances, c) means for rotating said roll while said portion of its outer circumference is partially submerged in said fluid whereby sterilant fluid becomes disposed within said pores, d) means directing the at least one aberrated surface of the paperboard material into rolling engagement with said fluid-containing pores of said roll to effect wettingly transfer of fluid from said pores to the aberrated surface of the paperboard.

5. The apparatus of claim 4 including a doctor blade in sliding contact with the free surface of said roll surface and positioned immediately downstream of the reservoir fluid surface.

6. The apparatus of claim 4 wherein the number, size and spatial separation of said pores in engagement with the aberrated surface of the paperboard material are sufficient to transfer to the aberrated surface of the paperboard material a substantially uniform layer of said fluid, the quantity of fluid transferred to any given portion of the aberrated surface of the paperboard material being not materially in excess of that quantity of fluid required to effect sterilization of the aberrated surface of the paperboard material without accumulation of sterilant fluid within or contiguous to an aberration in the aberrated surface of the paperboard material.

7. In a paperboard asceptic packaging machine wherein said paperboard includes a surface characterized by one or more aberrations in the smoothness and/or continuity of the surface is sterilized using a fluid sterilant prior to forming a package the improvement comprising:

a) a roll having a multiplicity of porous cavities disposed about the cylindrical surface thereof, b) means for applying a liquid sterilant upon the cylindrical surface of said roll whereby said pores of said roll are caused to fill with said sterilant, c) means for removing from the cylindrical surface of said roll excess sterilant over that sterilant contained within said pores, d) a pressure roll having its axis of rotation parallel to the axis of rotation of said roll and having its cylindrical surface in rolling contact with the cylindrical surface of said roll forming a pressure nip therebetween for receipt therein of a paperboard web whereby the aberrated surface of said paperboard web passing through said nip and between said pressure roll and said roll is wetted by said fluid sterilant, the quantity of fluid transferred to any given portion of the aberrated surface of the paperboard being not materially in excess of that quantity of fluid required to effect sterilization of the aberrated surface of the paperboard material without accumulation of sterilant fluid within or contiguous to the peripheral margin of an aberration in the aberrated surface of the paperboard.

8. The apparatus of claim 7 wherein said means for applying said sterilant to said roll comprises spray means whereby said liquid sterilant is sprayed upon the cylindrical surface of said roll.

9. The apparatus of claim 7 wherein said means for applying said sterilant to said roll comprises a reservoir of said sterilant and means rotating said roll relative to said reservoir of fluid whereby said liquid sterilant is caused to fill said pores of said roll.

10. The apparatus of claim 7 and including a transfer roll having its axis parallel to the axis of said roll and in rolling contact with the surface of said roll at a position external to said reservoir of sterilant whereby sterilant disposed within the pores of said roll is transferred to said transfer roll, and a pressure roll having its axis parallel to the axis of said transfer roll and in rolling contact with said transfer roll forming a pressure nip therebetween for receipt therein of said paperboard whereby said fluid associated with said transfer roll is transferred to said aberrated surface of said paperboard as said paperboard passes between said transfer roll and said pressure roll.

11. A method of sterilizing a paperboard material having a surface characterized by one or more aberrations in the smoothness and/or continuity of the surface comprising the steps of:

a) providing a reservoir of sterilant fluid, b) providing a roll having at least a portion of its outer circumference submerged in said fluid, said roll having defined in the outer circumference thereof a plurality of minute discrete pores opening outward of the outer circumference of the roll, said pores being spaced apart by respective minimal distances, for the receipt of a quantity of sterilant fluid therein, c) rotating said roll within said fluid such that the pores of said roll receive therein a quantity of said fluid, d) removing from the outer circumference of said roll substantially all sterilant fluid not disposed within said pores, e) providing a pressure roll contiguous to said roll to define a pressure nip therebetween, f) passing the paperboard material through said pressure nip to expose said aberrated surface of the paperboard material to said fluid in said pores within said pressure nip, whereby within said pressure nip, said fluid in said pores exposed to said aberrated surface of the paperboard material is wettingly transferred from said pores to essentially the entire aberrated surface of the paperboard material, including within the aberrations of the paperboard, in the form of a substantially uniform layer of said fluid, the quantity of fluid transferred to any given portion of said aberrated surface of the paperboard material being not materially in excess of that quantity of fluid required to effect sterilization of said aberrated surface of the paperboard material without accumulation of sterilant fluid within or contiguous the peripheral margin of an aberration in said aberrated surface of the paperboard material.

12. The method of claim 11 wherein said roll and said pressure roll are in rolling contact.

* * * * *